US008978952B2

(12) United States Patent
Marks

(10) Patent No.: US 8,978,952 B2
(45) Date of Patent: Mar. 17, 2015

(54) POWER SPRING CONFIGURATIONS FOR A FASTENING DEVICE

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 573 days.

(21) Appl. No.: 13/412,202

(22) Filed: Mar. 5, 2012

(65) Prior Publication Data

US 2013/0228607 A1 Sep. 5, 2013

(51) Int. Cl.
*B25C 5/02* (2006.01)
*B25C 5/08* (2006.01)

(52) U.S. Cl.
CPC ..... *B25C 5/02* (2013.01); *B25C 5/0228* (2013.01)
USPC ..... 227/132; 227/134

(58) Field of Classification Search
CPC ..... B25C 5/02; B25C 5/0228; B25C 5/06
USPC ..... 227/83, 107, 120, 128, 132, 134
See application file for complete search history.

(56) References Cited

U.S. PATENT DOCUMENTS

| | | | | |
|---|---|---|---|---|
| 1,655,275 | A | 8/1925 | La Place | |
| 1,919,373 | A | 2/1931 | Krantz | |
| 2,087,242 | A | 7/1937 | Bunnell | |
| 2,137,642 | A | 11/1938 | Cavanagh | |
| 2,326,540 | A | 8/1943 | Tovstenson | |
| 2,493,640 | A | 1/1950 | Peterson | |
| 2,726,391 | A | 12/1955 | Pilblad | |
| 2,755,474 | A * | 7/1956 | Spencer | 227/124 |
| 2,769,174 | A | 11/1956 | Libert | |
| 2,884,636 | A | 5/1959 | Abrams | |
| 3,103,012 | A * | 9/1963 | Kohen et al. | 227/125 |
| 3,610,505 | A | 10/1971 | Males et al. | |
| 3,758,016 | A * | 9/1973 | Olney et al. | 227/132 |
| 3,940,044 | A | 2/1976 | La Pointe | |
| 3,948,426 | A | 4/1976 | La Pointe | |
| 4,126,260 | A | 11/1978 | Mickelsson | |
| 4,367,833 | A | 1/1983 | Kenney | |
| 4,450,998 | A | 5/1984 | Ruskin | |

(Continued)

FOREIGN PATENT DOCUMENTS

| | | |
|---|---|---|
| CH | 255111 | 6/1948 |
| GB | 2229129 | 9/1990 |

OTHER PUBLICATIONS

Engineering drawing (1 sheet attached) of applicant WorkTools' PaperPro Evo stapler offered for sale in the US in 2010, depicting internal power spring configuration.

(Continued)

*Primary Examiner* — Scott A. Smith
(74) *Attorney, Agent, or Firm* — Paul Y. Feng; One LLP

(57) ABSTRACT

Power spring configurations for a spring energized fastening device includes a compact double torsion power spring and two opposed compact single torsion springs. Simplified structures to hold the springs in a stable pre-loaded position are disclosed. Each coil has forward extending arms including an angled portion and forward vertically coincident portions. The double torsion spring has a self-locking crossing geometry to hold a pre-loaded rest position. The opposed two springs have a bridge and a mandrel to hold the rest position. A lever presses arms of the spring between a striker and the coil including a compact nesting condition. A tab of the striker extends forward to provide a release edge and a positioning torque bias upon the striker.

25 Claims, 5 Drawing Sheets

(56) References Cited

U.S. PATENT DOCUMENTS

| | | | | |
|---|---|---|---|---|
| 4,452,388 | A | 6/1984 | Fealey | |
| 4,463,890 | A | 8/1984 | Ruskin | |
| 4,629,108 | A | 12/1986 | Judge | |
| 5,328,075 | A | 7/1994 | Marks | |
| 5,335,838 | A | 8/1994 | Harris et al. | |
| 5,335,839 | A | 8/1994 | Fealey | |
| 5,356,063 | A | 10/1994 | Perez | |
| 5,407,118 | A * | 4/1995 | Marks | 227/132 |
| 5,497,932 | A | 3/1996 | Brewer et al. | |
| 5,664,722 | A | 9/1997 | Marks | |
| 5,699,949 | A | 12/1997 | Marks | |
| 5,816,470 | A | 10/1998 | Plato et al. | |
| 5,988,478 | A | 11/1999 | Marks | |
| 6,145,728 | A * | 11/2000 | Marks | 227/132 |
| 6,244,491 | B1 | 6/2001 | Kandasamy et al. | |
| 6,550,661 | B2 | 4/2003 | Aoki | |
| 6,626,346 | B2 | 9/2003 | Jairam et al. | |
| 6,789,719 | B2 | 9/2004 | Shor | |
| 6,918,525 | B2 | 7/2005 | Marks | |
| 6,966,479 | B2 | 11/2005 | Tanaka et al. | |
| 7,097,086 | B2 | 8/2006 | Joyce et al. | |
| 7,097,088 | B2 | 8/2006 | Shor | |
| 7,118,019 | B2 | 10/2006 | Marks | |
| 7,121,444 | B2 | 10/2006 | Joyce | |
| 7,124,922 | B2 | 10/2006 | Marks | |
| 7,124,924 | B2 | 10/2006 | Marks | |
| 7,140,526 | B2 | 11/2006 | Matsukawa | |
| 7,178,709 | B2 | 2/2007 | Marks | |
| 7,234,621 | B2 * | 6/2007 | Marks | 227/8 |
| 7,243,832 | B2 | 7/2007 | Jiang | |
| 7,387,227 | B1 | 6/2008 | Jiang et al. | |
| 7,395,955 | B2 * | 7/2008 | Zins et al. | 227/132 |
| 7,464,845 | B2 | 12/2008 | Chou | |
| 7,513,406 | B2 * | 4/2009 | Marks | 227/120 |
| 7,540,400 | B2 | 6/2009 | Zins et al. | |
| 7,681,771 | B2 | 3/2010 | Kandasamy et al. | |
| 7,708,179 | B2 | 5/2010 | Marks | |
| 7,748,589 | B2 | 7/2010 | Marks | |
| 7,823,759 | B2 | 11/2010 | Jiang | |
| 7,828,184 | B2 | 11/2010 | Marks | |
| 7,950,558 | B2 | 5/2011 | Marks | |

OTHER PUBLICATIONS

Worktools, Inc.; International Searching Authority; PCT Notification of Transmittal of the International Search Report and the Written Opinion of the International Searching Authority, or the Declaration; May 10, 2013; 8pp.

* cited by examiner

POWER SPRING CONFIGURATIONS FOR A FASTENING DEVICE

BACKGROUND

The present invention relates to spring energized fastening tools. More precisely, the present invention relates to improvements to the spring and release of a spring-actuated stapling device.

Spring powered staplers and staple guns operate by driving a striker with a power spring. The striker ejects a staple by impact blow. In a desktop stapler, the staple is ejected into an anvil of a pivotally attached base. In a staple gun, the fastener is normally installed directly into a work surface. Two general principles are used in either type device. In the first design, the striker has an initial position in front of a staple track. The striker is lifted against the force of the power spring to a position above the staple track. The striker is released to impact and eject the staple. This design may be referred to as a "low start" stapler. A second design uses a "high start" position. That is, the striker has an initial position above the staples loaded on the staple feed track. The power spring is deflected while the striker does not move. At a predetermined position of the power spring deflection, the striker is released to accelerate into and eject a staple. A handle normally serves as an energy input device although motorized versions need not have a handle. Spring energized staple gun tackers have traditionally used a low start configuration although high start type tackers are known. Spring energized desktop staplers of both types are currently available.

In both high and low start types, the power spring can be made of wire or have a flat metal shape. The flat metal types are normally elongated along a length of the body. Wire springs may be horizontally elongated or vertically oriented compression style. Modern designs tend toward the elongated type, for example a torsion spring with extended arms.

A limitation of conventional designs is the absence of simplified structures to preload a torsion spring in a high start type. Further, an improvement is called for in providing a more compact lever arrangement to operate with the simplified wire spring.

In comparing a flat spring to a wire spring design, the length tolerance of an elongated flat spring is relatively precise, being limited mostly by the precision of the blank cut out for it, in the case that the spring is of reasonably straight bend. For a wire spring, however, the arm length may be less precise since it depends on the manner in which the coil is wound among other factors. It is therefore desirable to have a release mechanism that is less sensitive to spring length with a high start type wire spring.

SUMMARY OF THE INVENTION

The present invention is preferably directed to a high start type stapler, although the improvements in part or whole may be applied to a low start type or other fastening devices.

In one exemplary embodiment the present invention, vertically co-incident arms extend forward from at least one coil of a torsion spring. Preferably two co-axial coils provide a base for four forward extending wire arms, where some portions of these wires are at least nearly coincident with respect to a side view. Normally a majority of energy is stored in the spring by deflection of the coil of the torsion spring. However, the arms are at least partially resilient so that the arms also may store some useful energy as well. A first pair of arms extend from the coil to the striker. A second pair of arms normally press the first pair in a rest condition, while the second pair may be forcibly deflected away from first arm pair as the spring is energized. The preferred embodiment improved structures preload the torsion spring arms in the rest condition. In particular, the arms cross to directly press each other at least at one crossing location or a small bridge connects them.

In one preferred embodiment, the power spring is a single-piece, dual torsion spring. In a further embodiment, the two coils are from separate, adjacent, opposed torsion springs. The springs according to the aforementioned constructions have been shown to be more efficient than conventional power spring designs. Advantages of increased efficiency are one or a combination of reduced handle travel for a lower or smaller grip, added performance, and reduced handle force. It follows that a smaller force spring can be used for a constant performance. For example, a 10% increase in efficiency can allow about a 10% lower force spring for a given application. This has a virtuous benefit that any friction in the system is also reduced by 10% since friction is a direct proportion to the force at a friction area.

The separate springs may be best suited for higher force or energy applications such as staple guns or high capacity staplers. In the case of separate springs, there is a tendency for the coils to twist away from each other from forces at the front as explained later. The coils spread apart to undesirably press and scrape the inner housing walls if not otherwise retained together. According to the preferred embodiment, a flanged mandrel retains the coils together wherein sliding friction at the coil area is substantially eliminated. The mandrel may therefore be of a simple, single-molded piece.

A lever pivots near the front of the stapler body near a location of the striker. The lever presses the first pair of wire arms to deflect the arms downward, as the second pair of arms remains restrained by engagement to the striker. The lever presses the arms directly.

In a further feature of the invention, an improved release mechanism is disclosed. A prior release design is disclosed in, for example, U.S. Pat. No. 7,708,179 (Marks), in FIGS. 21 to 23, and in another variation, U.S. Pat. No. 7,828,184 (Marks), both issued to the present inventor and both of which are incorporated herein by reference. In these designs, a power spring tip presses a latch to restrain the striker from moving as the spring is energized. At a pre-release position of the handle, a cam moves to allow the latch to pivot and free the striker to move downward. These designs include flat springs in the preferred embodiments, although wire springs can also be used and are contemplated.

In a preferred embodiment, a tab of the striker presses atop the latch. The power spring extends through both the striker and the latch, but is not restrained by the latch. A resulting advantage is the spring length, as defined by the position of the front tip, can vary without affecting the release action. By contrast, a latch engagement to the spring tip can be sensitive to the position of that tip. Further, a wire spring does not provide a well-defined flat release surface at its tip. In the preferred embodiment, the striker tab extends forward. Upon pressing the latch the tab creates a torque on the striker that biases the bottom of the striker forward. As discussed in detail later, when used with a dual thickness striker, this torque helps guide the striker in its motion.

These and other aspects, features, and advantages of the present invention will become apparent from the following detailed description of the preferred embodiments which, taken in conjunction with the accompanying drawings, illustrate by way of example the principles of the invention.

DETAILED DESCRIPTION OF THE PREFERRED EMBODIMENTS

Figure 9:
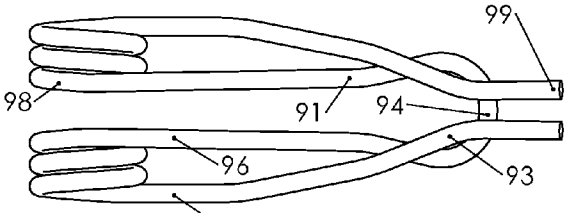
FIG. 9 is a top plan view of the power spring from the subassembly of FIG. 6.

FIGS. 1 to 12 show a standard duty desktop stapler including a preferred embodiment of the power spring of the present invention. For example, preferred embodiment power spring 90 includes coil 98 with terminal arm 95 and loop arm 96 extending forward from the coil, as seen in FIG. 9. Identical opposed elements of the double torsion spring may be addressed herein equivalently and in the singular for brevity. It is understood that there are two of each such element, or two pairs, in the preferred embodiment.

The present invention is directed to a spring energized fastening device. In a desktop stapler form seen in FIG. 1, base 120 or its equivalent structure is optionally included. Track 180 is at a bottom of housing 10 and guides staples or other fasteners (not shown) to striker 100 at the front of the stapler.

Figure 11:
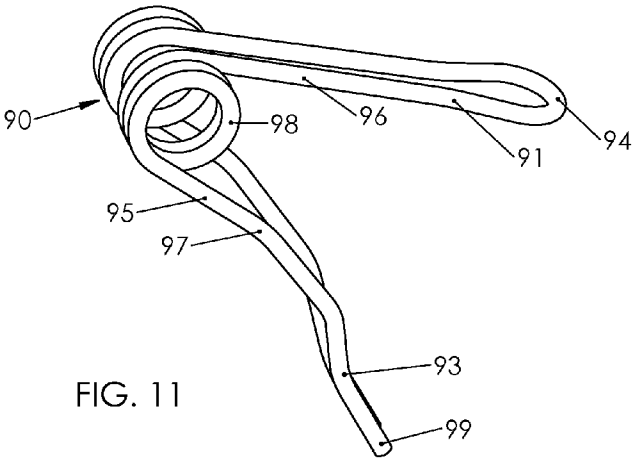
FIG. 11 is the power spring of FIG. 10 depicted in a free position.

In the power spring 90, the respective arms 95 and 96 include a free condition as shown in FIG. 11. This is a shape of the power spring 90 as it is manufactured. The arms 95, 96 are joined at base coil 98, where as illustrated each opposed coil has preferably about 2.5 revolutions or turns. More or fewer revolutions are contemplated. Terminal arm 95 includes bends 93 and 97 and terminal end 99. Loop arm 96 includes loop 94 and loop base 91.

The power spring 90 is preferably fabricated from spring steel that has been heat treated. One example of such steel is music wire. In a staple gun application, the wire is about 0.090-0.150" diameter inclusive of all dimensions within the specified out limits, while in a standard office desktop stapler application, the wire is about 0.06 to 0.08" diameter, inclusive of all dimensions within the specified outer limits. Other wire diameters or materials may be selected as required for specific applications; for example, a staple gun that is of heavier or lighter duty than provided by the stated wire types.

Figure 10:
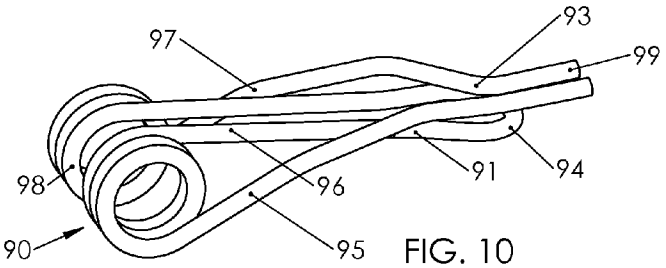
FIG. 10 is a right side, upper perspective view of the power spring of FIG. 9 in a rest position.

FIG. 10 shows a preloaded rest condition of exemplary power spring 90. Terminal arm 95 is forced up against spring bias beside loop arm 96, toward but not necessarily entirely to the condition of FIG. 12. The terminal arm 95 is then moved inward to overlie loop 94. Upon removing the applied force, the resilient arms press each other with bend 93 dipping slightly into the loop or at least being within the area described by the loop. The arms are thus preloaded to the extent that they are pressing each other in the position of FIG. 10. This operation may be done to both opposed terminal arms 95 at the same time or in sequence. Once in the rest condition of FIG. 10, the spring 90 is sufficiently stable for subsequent assembly operations. Bend 93 is restrained from sliding off of loop 94 by being contained within or confined by the loop. Alternatively, loop 94 may include upward bends (not shown) to confine arm 95 wherein bend 93 would be optional.

According to the above-described structure, power spring 90 maintains a preload without any additional components. The power spring 90 is thus restrained in its preloaded condition by folding against or crisscrossing itself. Specifically, the arms directly press each other at an arm preload location in a stable manner, such location being at a crossing of the arms.

Figure 12:
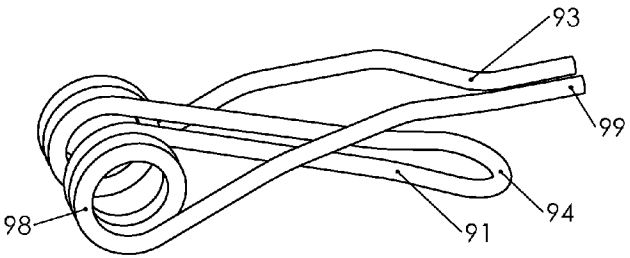
FIG. 12 is the power spring of FIG. 10 depicted in a pressed position corresponding to FIG. 7.

In FIG. 12 a pressed position of power spring 90 is shown. This position does not normally occur to the isolated spring, but rather corresponds to the pre-release condition within the assemblies of FIGS. 2 and 7. The assembly of FIG. 7 has various components not shown for clarity.

As best seen in FIG. 9, terminal arm 95 crosses from outside loop arm 96 to extend inside the loop arm. Therefore, each arm 95, 96 is alternately an inner and an outer arm depending on a selected location along the spring length. By passing over each other, the arms can press each other at a crossing location with no intervening parts. In this manner, the arms 95, 96 are substantially vertically coincident at the crossing locations. The terminal arm 95 crosses the loop arm 96 a second time at a front most part of the loop 94. Preferably, loop 94 of arm 96 is wider than the arm 96 portions rearward. This helps maintain a larger radius for ease of manufacture and presents a larger area for bend 93 to descend into. Optionally, depending on the particular geometry, there may be only a single crossing. For example, if arm 95 at bend 93 is farther out, it may just overlie loop 94 and be considered a single crossing.

Figure 1A:
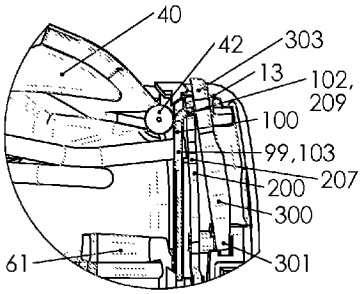
FIG. 1A is a detail view of a front upper area of the stapler of FIG. 1.
Figure 1:
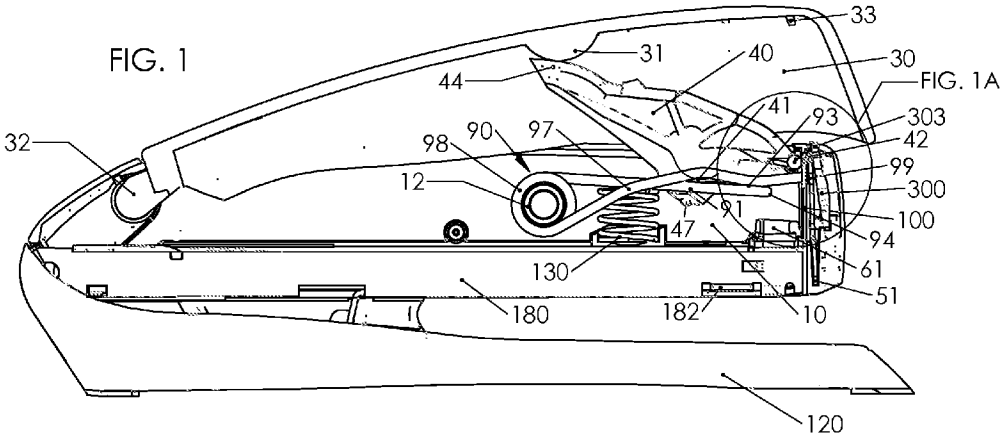
FIG. 1 is side elevational view of a desktop stapler with a right housing omitted for clarity. The stapler is depicted in a rest condition.
Figure 4:
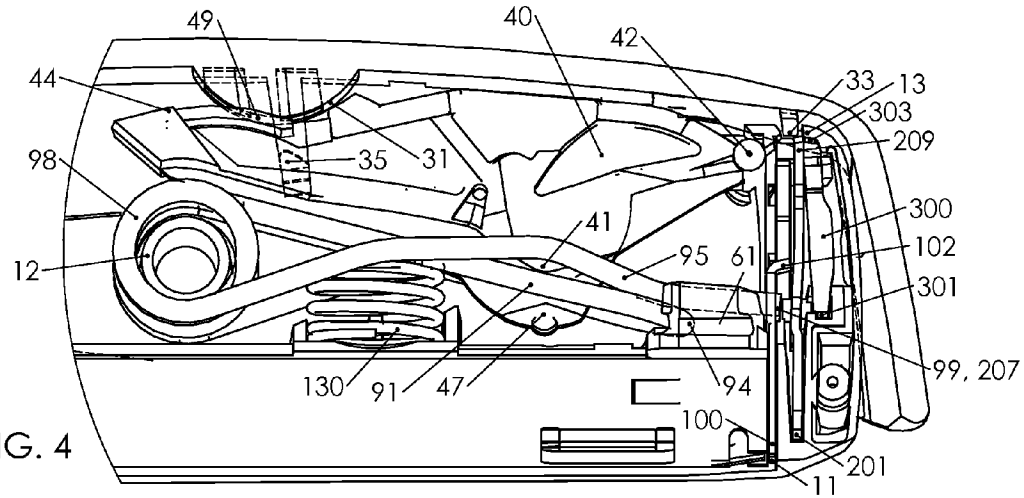
FIG. 4 is the view of the stapler from FIG. 2, with the stapler in a post-release condition.
Figure 6:
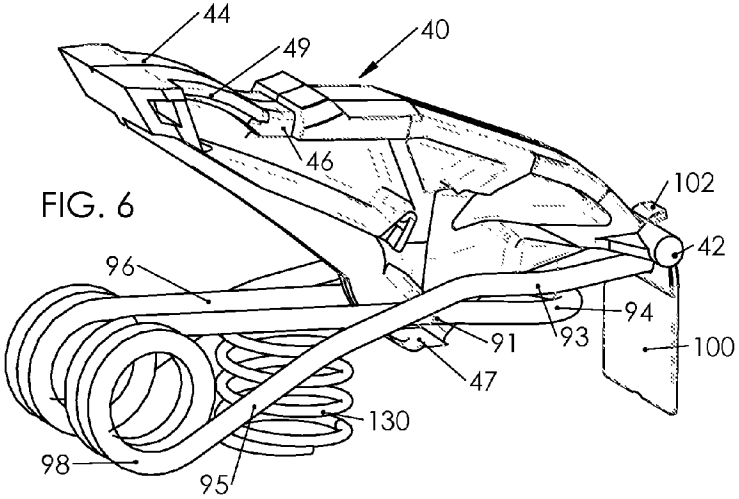
FIG. 6 is a rear perspective view of a subassembly of a lever, power spring, striker, and re-set spring from the stapler of FIG. 1 with the elements in a rest condition.
Figure 8:
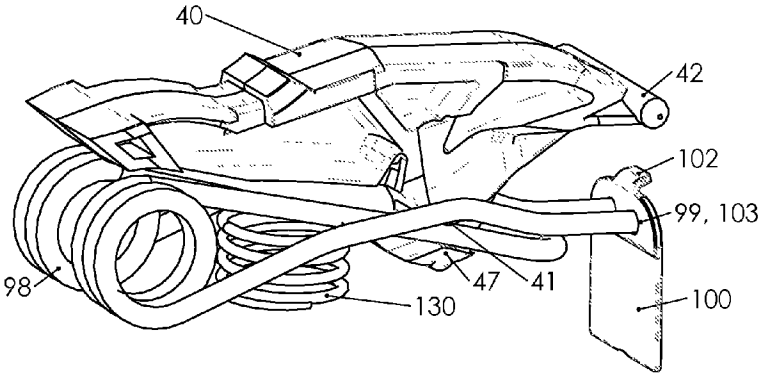
FIG. 8 is the subassembly of FIG. 6 with the elements in a post-release condition.

Regarding the assembly, FIGS. 1 and 6 show power spring 90 in the rest position of the isolated spring of FIG. 10. Lever 40 provides a link between handle 30 and power spring 90. As seen in FIGS. 5-8, lever 40 preferably has an inverted triangular shape with three vertices: one vertex is lever pivot point 42, a second vertex is fulcrum 41, and the third vertex is rear end 44 that engages the handle 30. The lever pivot point 42 is at a end thereof and the lever pivots about that end, while the opposite end of the lever corresponds to the rear end 44. As seen in FIG. 1, power spring 90 is pivotally mounted to housing 10 at post 12 of the housing. Rear end 44 is substantially aligned vertically with post 12 and coil 98, post 12 being a location for a rotational base of power spring 90. This relative position of lever rear 44 in housing 10 provides a practical travel of linked handle 30, in particular the positions shown from FIG. 1 to FIG. 2. In FIGS. 2 and 4 it is seen that rear end 44 is close to coil 98 or post 12 in the lever lowest position. Optionally, arms 95 and 96 may be shorter or longer to not so closely coincide with post 12. However too long arms may cause a too weak force at striker 100 from such a long torque arm as applied by a reasonably sized coil 98. If the arms are too short the arc radius at striker 100 is too small. This leads to excess friction from sliding at spring end 99 in striker opening 103 and non-vertical forces at striker 100 against slot 11.

Lever 40 presses the power spring 90 at fulcrum 41 of the lever near bend 91 of the power spring. This pressing point is between a location of striker 100 and post 12. According to the preferred embodiment of the invention, the lever 40 presses the power spring wire at a location substantially rearward of lever pivot point 42 (FIGS. 2, 4). In this manner, pressing the lever 40 at its rear end 44 creates mechanical advantage through the lever arm between lever pivot point 42 and fulcrum 41. The lever 40 acts directly on the power spring wire rather than through a further effective lever or linkage. This reduces overall part count, simplifies assembly, and eliminates friction and drag in the system. In FIG. 2, lever 40 is seen passing downward past largely stationary arms 95, thus becoming more deeply nested between the arms 95, in the pre-release position. In this context, becoming nested can mean moving from not nested or moving to be further nested between the arms. Lever 40 may include a further extension 47, discussed below, whereby the lever is normally nested within arms 96.

The user presses on handle 30 to operate the stapler. Handle 30 includes cam area 31 that slides along rear end 44 of lever 40 (FIG. 2). By pressing the lever 40 at progressively varying angles, handle 30 provides increasing leverage upon lever 40. In this manner, the force upon handle 30 as perceived by the user may remain relatively constant as power spring 90 is deflected and further energized from the rest position, FIG. 1, to the pressed position, FIG. 2.

Optional reset spring 130 normally biases the components upward in a reset stroke. In particular, reset spring 130 biases power spring 90 to move from the post-release position of FIG. 4 to the rest position of FIG. 1. However, under some conditions striker 100 may resist rising, for example, if a jam occurs. So lever 40 preferably includes a rib, recess, or tab 47 that underlies arm 96 (FIG. 2). Tab 47 provides a tensile link between the power spring 90 and the lever 40 to pull the power spring 90 and striker 100 upward when reset spring 130 cannot by itself do so. Tab 47 may be installed through the wide portion of loop 94 and slid rearward or by spreading the loop wires apart.

Figure 2A:
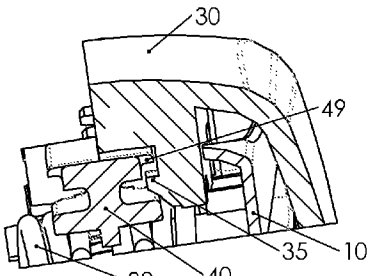
FIG. 2A is a cross-sectional view taken along line 2A from FIG. 2, showing detail of a lever-to-handle link.
Figure 2:
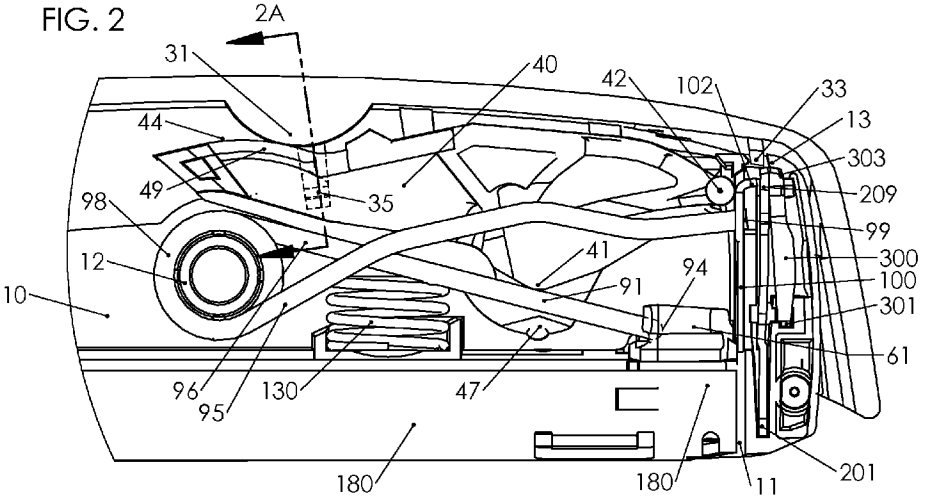
FIG. 2 is a detail view of the stapler of FIG. 1, in a pre-release condition.

A second tensile link is shown in a preferred embodiment of FIG. 2A between lever 40 and handle 30. This second link completes the tensile connection through lever 40 between power spring 90 and handle 30. Undercut tab 35, also shown hidden in FIG. 2, extends under rib 49 of lever 40 for all operative handle positions. Pulling up upon the handle 30 causes these elements to bias the lever 40 upward as they engage by sliding. To assemble tab 35 under rib 49, it is moved down along slot 46, FIG. 6, as handle 30 is manipulated during installation. Handle 30 is then moved rearward to its operative position at rear end pivot 32, FIG. 1 whereby tab 35 also moves rearward to become under rib 49.

To provide a compact form in a preferred embodiment, power spring 90 has arms 95 and 96 extending from coil 98 at an angle where the arms become coincident in a rest condition (as seen from the side views of FIGS. 1 and 4). The arms 95, then bend at 97 to continue to extend substantially coincident with respect to the side view. The power spring 90 thus includes a converging angled portion near the coil 98 and an extended, parallel and coincident forward portion. With this arrangement, the power spring 90 is compact vertically in the front area where the lever 40 and striker 100 interact with it. As shown bend 97 is in arm 95; optionally there may be an equivalent bend in arms 96 or in both pairs of arms. A low profile power spring allows the entire desktop stapler or staple gun, especially in a high start configuration, to have a low profile. A low profile desktop stapler is very attractive to consumers who want a sleek, unobtrusive office tool for use in the office, home, or school. A compact staple gun allows a comfortably small gripping distance around the spring location.

In power spring 90, arms 95 extend past loop 94 to engage striker 100. In FIG. 4 it can be seen that arm 95 near end 99 rests on an optional shock absorber 61. With loop 94 ending mostly rearward of absorber 61, arms 95 are exposed from below and there is room for the absorber 61 to engage arms 95 over a length segment of the arms when striker 100 rapidly moves down in the firing stroke. Such engagement is required, for example, when the fastening device is fired empty and there are no fasteners to otherwise stop the downward motion.

Figure 19:
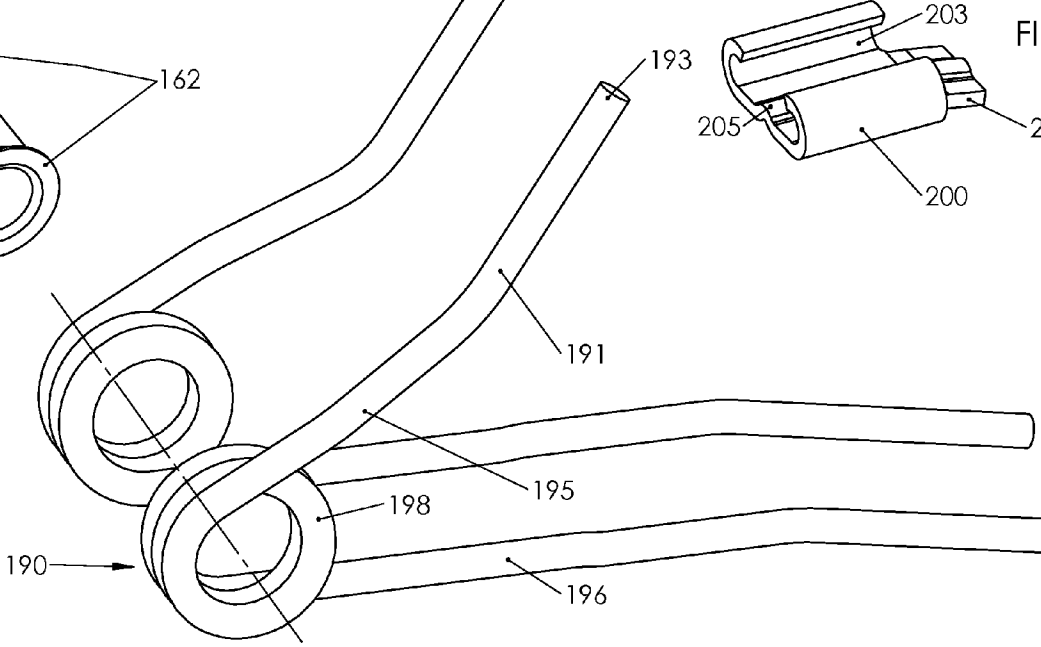
FIG. 19 is the subassembly of FIG. 15 showing only two opposed power springs, spaced apart, in a free position.
Figure 18:
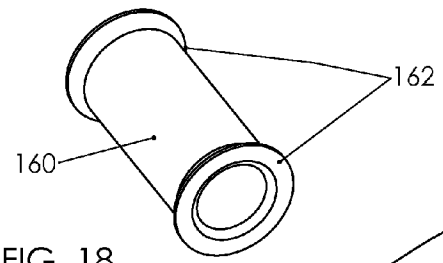
FIG. 18 is perspective view of a mandrel from the subassembly of FIG. 13.

FIGS. 13-20 show an alternative embodiment power spring 190. Power spring 190 preferably has two separate identical opposed torsion springs, as seen in FIG. 19. As discussed earlier regarding power spring 90, a singular reference in the description here to part of a spring shall include an opposed equivalent part.

In power spring 190 the opposed parts are proximate each other for preferably the full length of the spring. This provides a compact shape with respect to width. This may be useful when the stapling device is to be high energy, such as a staple gun or high capacity desktop stapler. For example, a staple gun using T-50 type staples or a desktop stapler of over 60-page capacity may be considered heavy-duty formats although such uses may include other formats. In a staple gun, the power spring should fit within a housing that is comfortable to grip; a desktop stapler should be reasonable size not to appear bulky.

Figure 14:
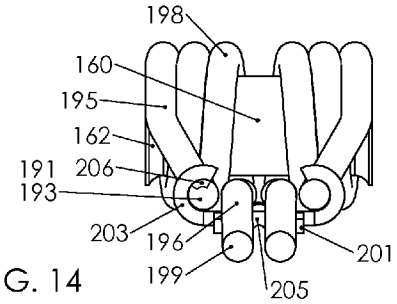
FIG. 14 is a front view of the subassembly of FIG. 13, absent the lever.

In accordance with the above goals, one embodiment of inner arms 196 including ends 199 are spaced near to each other. With no loop at the end, the arms 196 at ends 199 can engage a striker or equivalent structure (not shown) through a small opening or openings of the striker. Outer arm 195 extends forward at an angle toward inner arm 196 in the side view of FIG. 13. After bend 197, outer arm 195 extends to distal end 193 through portion 191 parallel, coincident, and adjacent to inner arm 196. Optional bridge 200 retains the opposed springs in a preloaded rest condition. Hooked section 203 of bridge 200 partially surrounds arm portion 191 (FIG. 14). Bridge 200 optionally includes central hump 205 (FIG. 20) in a floor of the bridge to hold inner arms 196 in a close but spaced-apart relation. Cage 200 thus holds the outer arms 195 from outside and above and the inner arms 196 from below, as seen in FIGS. 13-16.

The wire of power spring 190 is relatively thick. In one example staple gun application, the wire is about 0.125-0.130" diameter, and inclusive of all dimensions in between the outer limits. So it is desirable to have the forward portions of the arms be very nearly coincident with respect to the side view, such as FIG. 13. In this way, the power spring 190 remains vertically compact. If the arms 195, 196 are coincident vertically they must therefore be separated laterally as seen in FIG. 14.

Within bridge 200, outer arm 195 is biased to rise relative to inner arm 196. This can be seen by comparing the free position of FIG. 19. So due to internal spring resilience, arm 195 at portion 191 presses up on bridge 200 while arm 196 presses down. Since the arms are spaced laterally there will be a torque arm across this space, horizontally in FIG. 14, to create a twisting bias on the power spring 190, tending to cause the left side coil 198 of FIG. 14 to rotate counterclockwise and the opposed right coil 198 to rotate clockwise. If there are a large number of coils 198, the twisting bias will have a reduced effect since the coils will be wide enough, horizontal direction in FIG. 14, to provide stability. However, such a spring or spring assembly will not be compact. Also, this effect is not a factor in the preceding single piece power spring 90. In that case, the arms are substantially coincident laterally, vertical direction on the page in FIG. 9. So there is no torque arm to create a torsion bias on the coils. Further, loop 94 ties the two sides of the power spring 90 together to resist any twisting between the sides.

Figure 13:
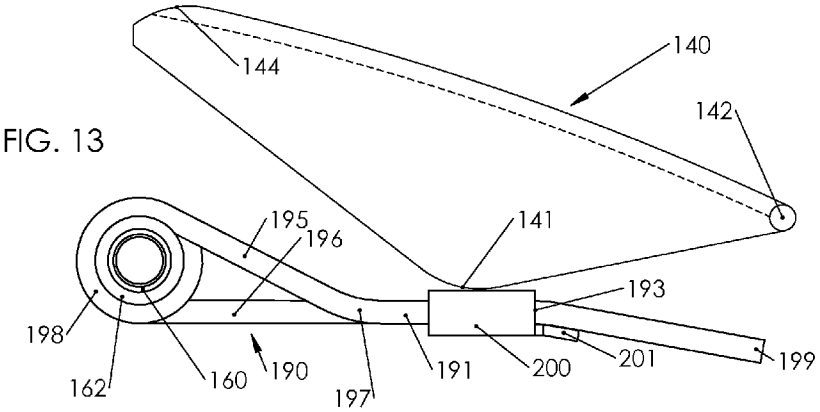
FIG. 13 is a side elevational view of an alternative embodiment power spring-lever subassembly, depicted in a rest position.

Without remedy, the coils 198 of compact power spring 190 tend to twist away from each other and may be unstable within a stapler housing (not shown). It will improve this twisting condition to include an optional mandrel 160 upon which coil 198 is guided (FIGS. 13, to 17). There should be free play between mandrel 160 and coil 198 up to the deflection shown in FIG. 16 to prevent binding of the coil. Specifically, the coil 198 inner diameter remains greater than the mandrel outer diameter for all operative positions of the power spring 190. So the twisting bias on the coil 198 will cause the coil to skew on the mandrel 160. As the opposed coils spread apart accordingly, the assembled power spring 190 will become unnecessarily wide within the housing. Further, the coil will tend to wedge and bind on the mandrel in spite of the free play clearance causing excess friction at the coil as the spring deflects.

Preferably, mandrel 160 is a discrete component so that it may be part of a power spring sub-assembly. The mandrel 160 is then pivotable upon a post of the housing to better allow for rotational motion of the power spring 190. Preferably, the mandrel is made from a low friction material such as acetal, nylon, polypropylene, PTFE, or similar. However, optionally, such a mandrel may be included as an element of or integral to housing 10 or other component.

A solution is to the skewing bias includes flange 162 on mandrel 160 (FIGS. 14-16, 18). This flange 162 confines the outer coil 198 from moving axially on the mandrel 160. To assemble the coil 198 upon the flanged mandrel 160, the mandrel is preferably installed with spring 190 in the free condition of FIG. 19. In this condition, coil 198 is of a larger diameter than in the rest condition of FIG. 15 where the coil is wrapped toward closed. Optionally, the arms 195, 196 of the free condition spring 190 may be lightly urged further open to provide additional inside diameter space to clear the flange 162. The mandrel flange end can be slidably installed into the coil with no or minimal resistance. Empirical testing of working samples shows that either assembly method can work. The coils 198 are held securely between the flanges 162 when the power spring 190 is moved toward the rest or pressed conditions wherein the coil diameter decreases. Accordingly, the coil 198 is held more securely between the flanges as the deflection and spreading force increases since the coil inside diameter is substantially less than the flange diameter. Substantially less here means sufficient to reliably retain the coils from sliding out past the flanges. In all operative positions the central mandrel outer diameter, between flanges, is less than the coil inside diameter to prevent binding. Naturally, the flange 162 may in alternative embodiments have localized humps or protrusions rather than a full circumferential rim. According to one embodiment of the invention, the mandrel may thus be a single component where the flange is present as the power spring is installed over it. Optionally, mandrel 160 may have two spaced-apart or not spaced-apart halves joined by a rivet, for example (not shown). In this instance, a central part of the mandrel may be a narrow element of the rivet diameter. This alternative mandrel may have the spring assembled over the flange or the halves may be assembled about the spring coils. Optionally, the flanges may be discrete elements (not shown) held in place by the rivet.

It may be noted here that a torsion wire spring should operate to close the coil upon deflection. Alternatively, opening or unwinding the coil may energize the spring. However, this creates tensile stress on the inside of the coil wires and has inferior life properties so such applications are normally limited to low energy uses.

Alternatively to flanges 162, a wire or equivalent tensile tie may span arms 195 near to coil 198 to hold the arms together. The coils are then similarly held from spreading.

Figure 15:
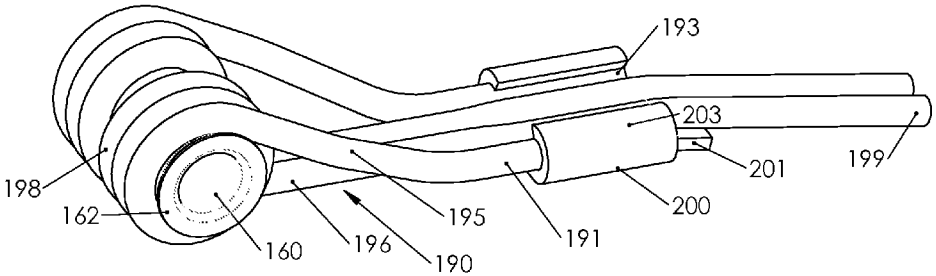
FIG. 15 is a rear upper perspective view of the subassembly of FIG. 13 absent the lever.
Figure 16:
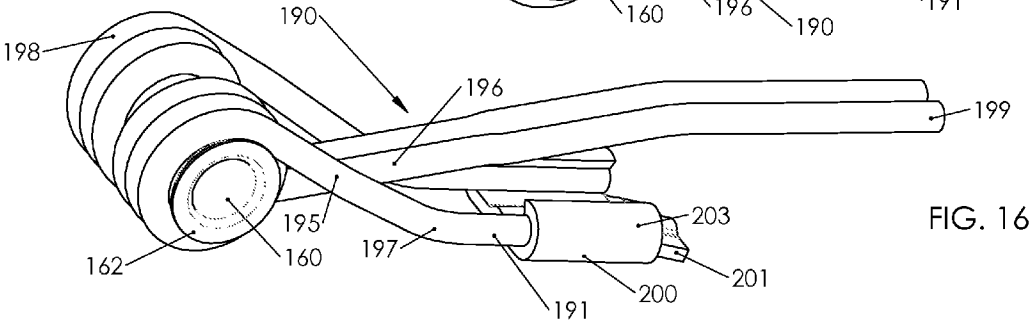
FIG. 16 is the subassembly of FIG. 15 in a pressed position.
Figure 17:
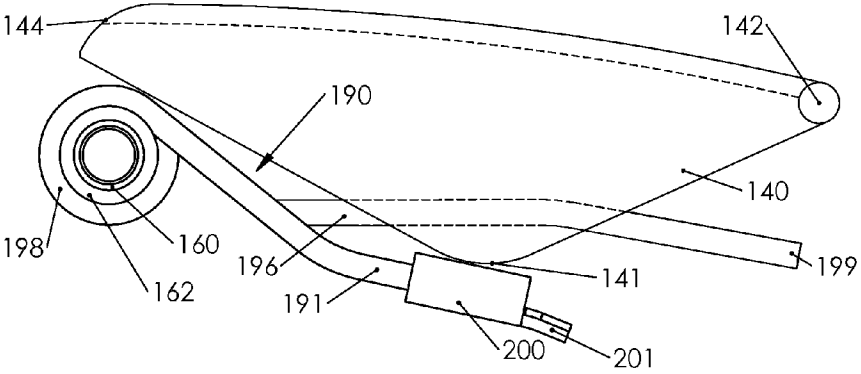
FIG. 17 is the subassembly of FIG. 13 moved to a pressed position.
Figure 20:
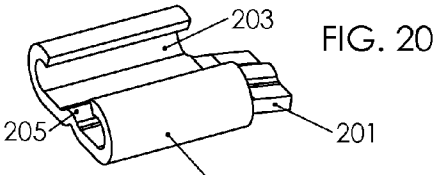
FIG. 20 is a bridge from the subassembly of FIG. 15.

To deflect and assemble power spring 190 to bridge 200 to arrive at its rest condition of FIG. 15, the two opposed power springs 190 are preferably positioned on a fixture (not shown) about mandrel 160 and deflected from the free condition, FIG. 19, to or toward the pressed condition, FIG. 16. Bridge 200 is installed into position. Mandrel 160 normally fits about a post of the housing (not shown).

Bridge 200 may include extension 201 (FIG. 20) to provide some additional support to the forward portion of arm 196. This helps engage a longer portion of spring material in the pre-load stress of the rest condition.

Empirical testing has shown a tendency for bridge 200 to slide rearward upon the spring in use. Therefore, there should be an optional crimp or other inhibiting structure to prevent such motion. For example, bridge 200 may be crimped at 206 (FIG. 14) to extend over end 193 of the spring arm in FIG. 14.

As with single spring 90 above, arms 195 near end 199 extend past bridge 200 in power spring 190. This exposed underside area of arms 195 provides a surface for an absorber (not shown) to stop the motion of the power spring 190 at the end of a firing stroke.

FIGS. 13 and 17 show lever 140 that operates similarly to lever 40. Pivot 142 fits to the housing (not shown) while rear end 144 provides a cam interface for a handle (not shown). In the preferred embodiment, fulcrum 141 presses bridge 200. Pressing the bridge provides a larger diameter object to engage verse the wire of the power spring 190. Wear on lever 140 may thus be reduced. As illustrated in FIG. 17, lever 140 straddles inner arms 196 to extend below the inner arms in the pressed position. As discussed above for power spring 90, power spring 140 includes at least one position where rear end 144 is substantially vertically aligned with coil 198. Likewise, the lever lowest position in FIG. 17 has lever rear end 144 close to coil 198.

It has been described that power spring embodiment 190 is suited for staple guns or high capacity staplers. Naturally, the first embodiment single piece spring 90 may be scaled to serve in such devices if desired. Likewise the two-piece spring 190 may be used for a standard duty desktop stapler. Further, it may be desired that the opposed elements of either spring embodiment be not identically opposed if there is an advantage to fit a particular structure. For example, there may be extra or fewer bends on one side or the parts may be identical and not opposed, i.e. entirely identical.

In various alternative embodiments, it is also possible to use the power spring of the present invention as a single torsion spring. For example, in spring 90 loop 94 may terminate in a hook rather than a full loop (not shown). A single arm 95 corresponding to a single coil 98 could be moved to rest upon such hook. For spring 190, flanges 162 of the mandrel could provide useful guidance to a single coil to hold the coil from becoming skewed in a device.

An improved release mechanism or latch means for a high start type stapler is shown in FIGS. 1 to 4. The release mechanism or latch means is used to hold the striker in position while the power spring is energized when the handle is pressed, and then releases the striker to expel a fastener from the stapler by impact blow. A prior release system or latch means is shown, for example, in U.S. Pat. No. 7,828,184 (Marks), the contents of which are incorporated by reference. As in the present invention, the Marks '184 stapler includes a striker, a latch, and a latch holder. The latch holder operates similarly to the present latch holder 300, shown in FIG. 3. Latch holder 300 is attached at lower end 301 in a receiving recess of housing 10, FIG. 1A. Top end 303 normally is exposed in an opening atop the housing 10. Serpentine section 308 (FIG. 3) allows top end 303 to move resiliently toward lower end 301. As handle 30 is pressed down, tab 33 engages top end 303 to depress the latch holder 300. Top end 303 moves below shelf 13 of the housing (FIG. 2) and the latch holder 300 is then free to move forward.

Striker 100 moves vertically in slot 11 of housing 10 in FIG. 2. The striker 100 includes forward extending tab 102 at its top. Tab 102 rests on edge 209 of latch 200. Power spring 90 at ends 99 biases the striker 100 downward as the power spring is energized. Tab 102 extends at a slight upward angle whereby latch 200 is biased to slide forward under the tab as the tab is pressed. Latch holder 300 selectively prevents the latch 200 from moving as described above.

Figure 3:
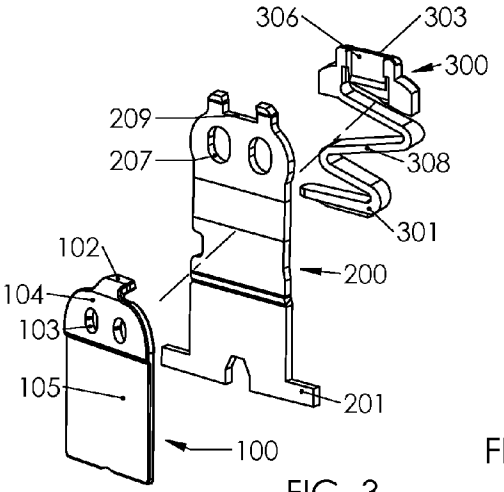
FIG. 3 is an exploded rear perspective view of a striker, latch, and latch holder from the stapler of FIG. 1.
Figure 5:
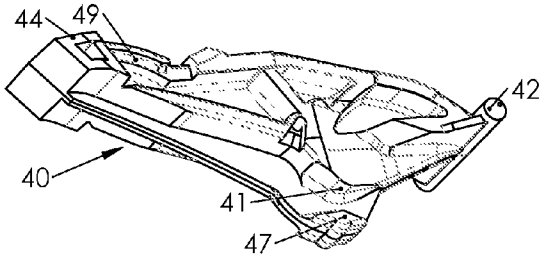
FIG. 5 is a rear lower perspective view of a lever from the stapler of FIG. 1.
Figure 7:
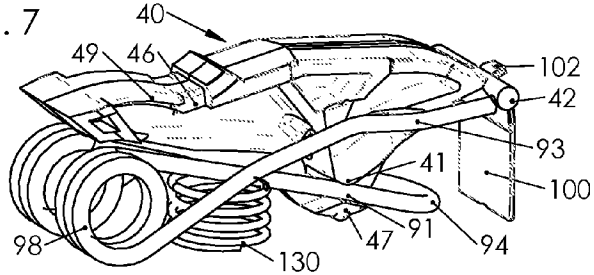
FIG. 7 is the subassembly of FIG. 6 with the elements in a pre-release condition.

The forward direction of tab 102 provides a particular advantage when used with a dual thickness striker as shown. As seen in FIG. 3, striker 100 includes a thin lower portion 105 and a thicker upper portion 104. The thin section fits a standard 0.020" staple dimension. The thicker upper section provides additional strength at openings 103 where power spring 90 engages the striker 100. However, in some low profile configurations there is no room for a structure to closely confine the striker from the rear at the lower portion. This is in the area of absorber 61 in FIG. 2. Rather thick upper portion 104 moves down to be near to track 180 in a striker lowest position, FIG. 4, leaving no room for any such rear guide surface for thin 105. As a result, striker 100 can rattle slightly at the lower end.

It is preferred that the striker 100 does not tilt rearward (clockwise in the drawings) as the power spring 90 is released. Otherwise the striker 100 may impact track 180 or a staple rearward of slot 11. One way to bias the striker 100 forward at the lower end is from the angle of power spring 90 at end 99. As seen in FIG. 1A, the power spring 90 will press on a rear edge of openings 103. This creates a counterclockwise bias to the striker in the FIG. 1A view and will lightly hold the lower portion of striker 100 against a front guide feature of the housing.

However, optionally, to further ensure the striker is biased forward at its lower area, tab 102 provides an improvement. The distance between the opening 103 and tab 102 with respect to the length direction (horizontal in FIG. 1A) creates a torque arm on striker 100. A net downward force at 103 and an upward force at 102 firmly hold the striker with its lower end forward as striker 100 is stationary in the upper position. Accordingly, a guide face or rib at the lower rear of striker 100 is not required for reliable guidance of the striker.

In a wire type torsion, spring a position of a terminal end, such as end 99, will be less precise than for a flat metal type. The flat metal spring is approximately accurate within the tolerance of the punching operation that forms the flat shape. However, the coil winding process and arm angle tolerance in a wire spring means such springs have a wider arm length tolerance. So it is preferable to release from the striker as shown herein rather than from a tip of the spring as has been done before. Latch 200 extends downward adjacent to and in front of striker 100. So to allow for arm length variations, latch 200 includes openings 207, seen in FIGS. 1A, 3. These openings 207 allow the spring tip to extend through a thickness of the latch 200. In this way, the position and length of end 99 may vary from just within striker opening 103 to within latch opening 207. To preserve the torque arm described above and reliability of the release action, it is preferable that the openings 207 in the latch not serve as a release edge. Rather, tab 102 shall have that function. So spring end 99 should not press within the opening 207. To ensure this is the case, opening 207 is larger than opening 103. As seen in FIG. 3, opening 207 is elongated for this reason. If a sufficiently precise length spring is used, then opening 207 may serve as a release feature instead of or in addition to tab 102.

Although the present invention has been described in terms of certain preferred embodiments, other embodiments that are apparent to those of ordinary skill in the art are also within the scope of the invention. Components and features of one embodiment may be combined with other embodiments. Accordingly, the scope of the invention is intended to be defined only by reference to the appended claims. While variations have been described and shown, it is to be understood that these variations are merely exemplary of the present invention and are by no means meant to be limiting.

I claim:

1. A spring energized fastening device including a housing, a power spring, a striker movable vertically at a front of the housing, and a fastener, the fastening device comprising:

a rest condition and a pre-release condition of the fastening device, the power spring being deflected in the pre-release condition whereupon the power spring is released to eject and install the fastener from the fastening device through energy stored in the deflected power spring;

the power spring being a torsion type including coaxial coils with at least four arms extending forward therefrom;

wherein the four arms include a first pair of arms being outer arms near a location of the coils, the first pair crossing a second pair of arms to become inner arms forward of the crossing location; and the power spring including a normal rest position wherein the arms are substantially vertically coincident at the crossing location and the first pair of arms presses the second pair of arms at the crossing location.

2. The spring energized fastening device of claim 1, wherein, with respect to a side view, one of the four arms extends forward from the coil at an angle toward a further arm, the one arm including a bend forward of which the two arms are substantially parallel and coincident.

3. The spring energized fastening device of claim 1, wherein the first pair of arms terminate in distal ends, and the distal ends engage the striker.

4. The spring energized fastening device of claim 3, wherein the second pair of arms are joined by a loop near the distal ends of the first pair, the crossing location is adjacent the loop, and respective bends of the first pair descend into the loop to retain the first pair laterally upon the loop.

5. The spring energized fastening device of claim 4, wherein the loop is spaced rearward from the striker, the distal ends of the first pair of arms extend past the loop to expose the arms from below in front of the loop, and the distal ends press an absorber in a lowest position of the striker.

6. The spring energized fastening device of claim 1, wherein a lever is pivotally attached at a lever pivot to the housing at the front of the housing proximate the striker, a handle is pivotally attached to the housing separately from the lever, the handle being linked to the lever so that moving the handle causes the lever to move, the lever including a fulcrum rearward of the lever pivot, and the fulcrum directly pressing at least one of the first and second pairs of arms of the power spring to deflect the power spring.

7. The spring energized fastening device of claim 6, wherein a tab of the lever extends under the spring wire at the fulcrum, the tab providing a tensile connection between the lever and the spring.

8. The spring energized fastening device of claim 6, wherein the lever presses one pair of the first and second pairs of spring arms and, in the pre-release condition, the lever moves below a further substantially stationary pair of spring arms to become nested among the further pair.

9. The spring energized fastening device of claim 1, wherein the striker includes an upper position above a staple track and a lower position in front of the staple track, and the striker remains substantially stationary in the upper position as the power spring is deflected.

10. A spring energized fastening device including a housing, a power spring, a fastener, and a striker movable vertically at a front of the housing, the fastening device comprising:

a rest condition and a pre-release condition of the fastening device, the power spring being deflected in the pre-release condition wherein the power spring is released to eject the fastener from the fastening device through energy stored in the deflected power spring;

the power spring having an assembly of two opposed separate torsion springs including coaxial coils with four arms extending forward there from, the torsion springs including a free position, a rest position and a pressed position, the coils being of a larger diameter in the free position than the rest position;

wherein the four arms include a first pair of arms being outer arms and second pair of arms being inner arms;

a mandrel co-extending within the coils wherein the coils are supported on the mandrel, in the rest or pressed positions of the power spring the coils are biased to spread apart from each other upon the mandrel, wherein the mandrel includes opposed flanges to each side of the spring coils to confine the coils from spreading; and wherein the mandrel includes an enlarged diameter flange, and the flange fits slidably through an inside diameter of a coil when the torsion spring is near its free position, and in the pressed position of the spring, the inside diameter is substantially less than a diameter of the flange.

11. The spring energized fastening device of claim 10, wherein the mandrel pivotally fits upon a post of the housing.

12. The spring energized fastening device of claim 10, wherein the inner arms extend immediately adjacent to each other, and a front end of the inner arms engages the striker.

13. The spring energized fastening device of claim 10, wherein with respect to a side view, an arm extends forward from the coil at an angle toward a further arm, the arm including a bend forward of which the two arms are substantially parallel and coincident.

14. The spring energized fastening device of claim 10, wherein arms of the springs are assembled to a bridge, the bridge holds the arms in a spring rest condition wherein the arms are substantially parallel and coincident at a location of the bridge.

15. The spring energized fastening device of claim 14, wherein the inner arms extend past the bridge to engage the striker, and an underside of the inner arms presses an absorber in a striker lowest position.

16. The spring energized fastening device of claim 14, wherein a lever is pivotally attached at a lever pivot to the housing at the front of the housing proximate the striker, a handle is pivotally attached to the housing separately from the lever, the handle being linked to the lever so that moving the handle causes the lever to move, the lever includes a fulcrum rearward of the lever pivot, and the fulcrum presses a pair of arms of the power spring at the bridge to deflect the power spring.

17. The spring energized fastening device of claim 14, wherein, in the rest condition, the bridge includes hooks around the outer arms to retain them against an upward force and a floor of the bridge crosses between the two separate springs to retain the inner arms against a downward force.

18. The spring energized fastening device of claim 17, wherein a hump in the floor holds a space between the two inner arms.

19. The spring energized fastening device of claim 17, wherein the floor extends forward of the hooks.

20. The spring energized fastening device of claim 10, wherein a lever is pivotally attached at a lever pivot to the housing at the front of the housing proximate the striker, a handle is pivotally attached to the housing separately from the lever, the handle being linked to the lever so that moving the handle causes the lever to move, the lever including a fulcrum rearward of the lever pivot, the fulcrum pressing a pair of arms of the power spring to deflect the power spring, and in a pre-release position the lever straddles the inner arms to extend below the inner arms.

21. A spring energized fastening device including a housing, a power spring, and a striker movable vertically at a front of the housing, the fastening device comprising:

a rest condition and a pre-release condition of the fastening device, the power spring being deflected in the pre-release condition wherein the power spring is released to actuate an ejection action through energy stored in the deflected power spring;

the power spring having an assembly of two opposed separate torsion springs including coaxial coils with four arms extending forward there from, the torsion springs including a free position, a rest position and a pressed position;

the four arms include a first pair of arms being outer arms and second pair of arms being inner arms;

a mandrel of the power spring assembly co-extending within the coils wherein the coils are supported on the mandrel, the mandrel being of a smaller outer diameter than an inner diameter of the power spring coils in the rest position of the springs; and wherein the coils are biased to twist and spread apart from each other on the mandrel in a preloaded condition of the power spring, the mandrel including protruding flanges at each end of the mandrel to confine the coils from spreading, the flanges being at least in part a larger diameter than the inner diameter of the power spring coils in the rest position of the springs.

22. The spring energized fastening device of claim 21, wherein a bridge extends between the spring arms at a forward position of the arms, the bridge holding the arms in a preloaded rest position of the springs.

23. The spring energized fastening device of claim 22, wherein an outer arm of a torsion spring is spaced laterally from an inner arm of the torsion spring, the arms press the bridge in opposed vertical directions to create a horizontal torque arm, the torque arm causing the twist bias upon the coils.

24. The spring energized fastening device of claim 21, wherein a spring has a free position, and a flange fits slidably through an inside diameter of a coil of the spring in the spring free position.

25. The spring energized fastening device of claim 21, wherein the coils are assembled upon the mandrel before at least one flange is formed to the mandrel.

* * * * *